US005167278A

United States Patent [19]

Goldschild

[11] Patent Number: 5,167,278

[45] Date of Patent: Dec. 1, 1992

[54] WELL TESTING APPARATUS

[75] Inventor: Pierre Goldschild, Vulaines sur Seine, France

[73] Assignee: Schlumberger Technology Corporation, Houston, Tex.

[21] Appl. No.: 563,658

[22] Filed: Aug. 7, 1990

[30] Foreign Application Priority Data

Aug. 18, 1989 [FR] France ..... 89 11005

[51] Int. Cl.[5] ..... E21B 34/14; E21B 43/12; E21B 47/06

[52] U.S. Cl. ..... 166/113; 166/250; 166/332

[58] Field of Search ..... 166/113, 332, 72, 242, 166/250

[56] References Cited

U.S. PATENT DOCUMENTS

| | | | |
|---|---|---|---|
| 4,108,243 | 8/1978 | King et al. | 166/66 |
| 4,149,593 | 4/1979 | Gazda et al. | 166/113 |
| 4,252,195 | 2/1981 | Fredd | 166/314 |
| 4,278,130 | 7/1981 | Evans et al. | 166/332 |
| 4,508,174 | 4/1985 | Skinner et al. | 166/332 X |
| 4,553,599 | 11/1985 | Glotin | 166/332 |
| 4,583,592 | 4/1986 | Gazda et al. | 166/332 X |
| 4,669,537 | 6/1987 | Rumbaugh | 166/113 |
| 4,678,035 | 7/1987 | Goldschild | 166/250 |
| 4,790,378 | 12/1988 | Montgomery et al. | 166/332 X |
| 4,830,107 | 5/1989 | Rumbaugh | 166/113 X |
| 4,842,064 | 6/1989 | Gazda | 166/250 |

*Primary Examiner*—Hoang C. Dang

*Attorney, Agent, or Firm*—Henry N. Garrana; John H. Bouchard

[57] ABSTRACT

Apparatus for testing an oil well comprises a tubular test string (10) fixed at the bottom of production tubing (11) and including a ball test valve (14) at its bottom end. The apparatus also includes a wireline assembly (50) suspended from a cable (51) so as to be capable of being lowered down the tubing. Beneath a measurement device (53) the wireline assembly includes a housing suitable for engaging in the test string (10), and an actuator rod suitable for engaging a moving sleeve (34) mounted in the tubular test string. By exerting traction on the cable (51) the sleeve (34) is raised, thereby opening a distributor valve (52) received in the thickness of the wall of the test string (10), and thereby putting the fluid situated beneath the test valve (14) into communication with the measurement device (53) via a passage (20).

14 Claims, 5 Drawing Sheets

WELL TESTING APPARATUS

BACKGROUND OF THE INVENTION

The invention relates to an apparatus designed to be attached to the bottom portion of a tubing in a well in order to perform tests for determining the characteristics of an earth formation into which the well penetrates and the changes to be expected therein as a function of time.

These tests consist mainly in measuring pressure variations following one or more successive operations of closing and opening the well at the bottom end of the tubing.

To this end, one well test apparatus comprises a test valve mounted at the bottom of the tubing and a measurement assembly including, in particular, a pressure sensor. In addition, the apparatus is designed so as to enable the test valve to be remotely controlled.

In some test apparatuses such as Schlumberger's "PCT full bore" apparatus, a ball test valve is used which is controlled by a pressure pulse sent from the surface, and the results of pressure measurements are stored downhole by recorders until the apparatus is extracted from the well. The information is therefore not immediately available for exploitation.

In order to remedy this drawback, proposals have been made, as described in particular in U.S. Pat. No. 4,678,035 to place a flapper valve above an existing ball valve and to actuate the flapper valve mechanically by means of a wireline assembly suspended on an electrically conductive cable. This wireline assembly then includes measurement sensors that deliver signals which are immediately transmitted to the surface via the cable. Compared with the preceding test apparatus, such test apparatus has the advantage of enabling the results of the pressure, temperature, and/or flow rate measurements performed to be obtained in real time.

Usually, the test apparatus described in patent U.S. Pat. No. 4,678,035 is mounted in a string which already includes a ball valve beneath said apparatus. However, the ball valve is then not used since the well is opened and closed under the control of the flapper valve in the test apparatus described in this U.S. patent.

In addition, the test apparatus described in U.S. Pat. No. 4,678,035 suffers from certain drawbacks.

Thus, if some device such as a perforator gun is conveyed to the bottom of the tubing through the flapper valve, it can happen that while it is being raised, the device causes the valve to close. This can lead to the device being damaged, and also to the flapper valve being damaged, and in the worst cases, it can also lead to the device being jammed inside the test apparatus.

In addition, reopening the flapper valve takes place by releasing the tension exerted on the cable, after equalizing the pressures on opposite sides of the flapper valve via small ducts provided for this purpose. Consequently, a considerable period of time may be necessary after a long period of closure and in the presence of a high pressure difference across the flapper valve.

Finally, when the well is open, measurements are performed while the cable is in a relaxed or slack position, thereby running the risk of damaging the cable.

In order to remedy these drawbacks, proposals have been made to use a ball valve in order to control opening and closing of the well, and to transmit information relating to the fluid situated beneath the valve to measurement means incorporated on a wireline assembly comparable to that which is described in U.S. Pat. No. 4,678,035. The fluid is transmitted via a passage bypassing the ball valve. In order to ensure that well closure is not affected by the presence of this passage, the upstream and downstream portions thereof are normally isolated from each other by a sealing gasket mounted on a sliding sleeve disposed coaxially inside the tubular assembly carrying the ball valve. When the wireline assembly is in place, the upstream and downstream portions of the passage are put into communication by exerting traction on the cable, and this has the effect of displacing the sleeve upwards and of placing the upstream and downstream portions of the passage on the same side of the sealing gasket carried by the sleeve.

Although this solution has the advantage of being simpler than the preceding solution and of avoiding the drawbacks associated therewith, it nevertheless suffers from a major difficulty. Given that the sleeve makes contact with the wall of the tubular assembly via large diameter sealing gaskets (e.g. about 65 mm in diameter), displacement of the sleeve requires a traction force to be applied which can be very high when the pressure difference across the gaskets reaches large values. Given that the pressure difference may reach or even exceed 500 bars, the traction force that needs to be exerted on the cable in order to maneuver the sleeve may exceed 400 kg. Given the relative weakness of the cable, there is a high risk of it breaking.

The object of the present invention is to provide a well test apparatus operating on a principle analogous to that of the last-described solution above, but having a special structure for opening the passage via which the space situated beneath the ball valve communicates with the measurement means in the wireline assembly, enabling the passage to be opened by a smaller traction force that does not endanger the mechanical strength of the cable.

SUMMARY OF THE INVENTION

According to a first aspect of the invention, this result is achieved by means of an apparatus for testing an oil well comprising: a tubular body adapted to be connected to a production tubing; a test valve mounted in said body and controlled from the surface for closing the well; passage means in said body communicating with the bore of said tubular body via first and second openings disposed above and below said test valve; a distributor valve movably mounted within the wall of said tubular body between a closed and an open position of said passage means, said distributor valve including coupling means extending into the bore of said tubular body; a wireline assembly suspended from an electrically conductive cable, said wireline assembly including a measurement device and a housing which is adapted to be releasably attached to said tubular body in a position where said measurement device is in fluid communication with the first opening of said passage means; and an actuator movably mounted in said wireline assembly and releasably engageable with said coupling means of the distributor valve, for actuating said distributor valve between said closed and open positions in response to traction exerted on the cable.

Since the distributor valve controlling the opening and closing of the passage means is totally received within the thickness of the wall of the tubular body, it includes sealing gaskets which are very small in diameter, e.g. about 10 mm, and it can therefore be displaced without difficulty even when the pressure difference across the gaskets is large.

Resilient means normally urges the distributor valve towards the closed position.

In a preferred embodiment of the invention, the distributor valve comprises a valve element mounted for translation parallel to the axis of said tubular body in a chamber of the tubular body, the valve element carrying upper, lower and intermediate sealing means which slidably engage the chamber wall. The passage means are arranged to open out in said chamber at first and second orifices located between the upper and lower sealing means and longitudinally spaced apart such that the intermediate sealing means is located (i) between the orifices when the distributor valve is in the closed position and outside the interval between the orifice when the distributor valve is in the open position.

The distributor valve also comprises first and second ducts in the tubular body for communicating the bore of the tubular body to the opposite ends of the chamber respectively to balance the pressures above and below the valve element.

Preferably the wireline assembly comprises a rod movable in translation in the housing and latching means on the rod for releasably coupling the rod to the coupling means of the distributor valve. The latching means comprises a ring member slidably mounted on the rod between high and low positions, spring means for normally maintaining the ring member in an intermediate position between the high and low positions, and latch members carried by the ring member and movable between (i) extended positions locked with the coupling means when the ring member is in said intermediate position and (ii) retracted positions released from said coupling means when the ring member is in one of said high and low positions.

According to another aspect of the invention, a test string apparatus for testing a well comprises: a tubular body adapted to be connected to a production tubing; a test valve mounted in said body and controlled from the surface for closing the well; passage means in said body communicating with the bore of said tubular body via first and second openings disposed above and below said test valve; a distributor valve movably mounted within said tubular body between a closed and an open position of said passage means; first coupling means on said body for releasably attaching a wireline assembly lowered in the tubing by a cable and for communicating the first opening of said passage means with a measurement device located in said wireline assembly; and second coupling means on said distributor valve, said second coupling means extending into the bore of said tubular body to be engageable by the wireline assembly so that said distributor valve can be operated by the wireline assembly in response to traction exerted on the cable.

BRIEF DESCRIPTION OF THE DRAWINGS

A preferred embodiment of the invention is described below by way of non-limiting example and with reference to the accompanying drawings, in which.

DESCRIPTION OF A PREFERRED EMBODIMENT

Figure 1:
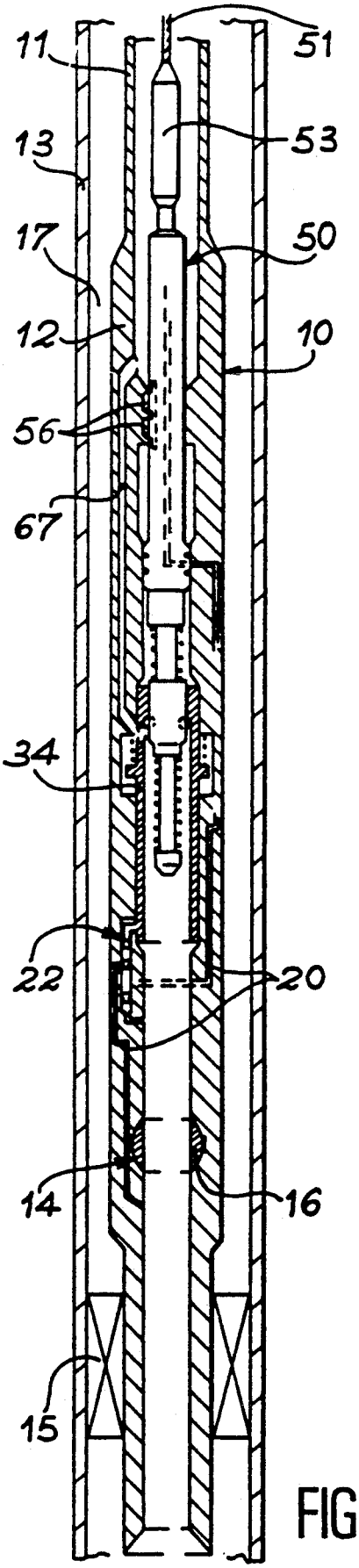
FIG. 1 is a diagrammatic vertical section view showing a testing apparatus in accordance with the invention in use at the bottom of an oil well.

As shown in FIG. 1, the well testing apparatus of the invention comprises a tubular test string 10 designed to be fixed in sealed manner to the bottom of a tubing 11 constituted by a string of rods, which is in turn located inside the casing 13 lining the inside of a well. The tubular test string 10 shown in FIG. 1 is placed slightly above perforations (not shown) made through the casing into a subsurface formation producing hydrocarbon fluid, either in the form of a liquid, or in a form of a gas, or in the form of a mixture of liquid and gas. Between the perforations through the casing and the tubular test string 10, the tubing 11 includes a packer 15 which closes the annular space 17 between the tubing 11 and the casing 13 at this level.

The tubing 11 which extends from a surface installation (not shown) down the well to the level of the perforations made through the casing 13 is intended to channel the hydrocarbon fluid up to the surface installation.

The tubular test string 10 shown in FIG. 1 is essentially constituted by a tubular body 12 having a well test valve 14 housed in the bottom portion thereof. The tubular body 12 is constituted by a plurality of pipe lengths which are interconnected in sealed manner by threaded and tapped portions, as can be seen in particular in FIGS. 2 to 4. In conventional manner, the test valve 14 comprises a ball valve element 16 centered on the axis of the tubular body 12 and having a bore passing therethrough with the diameter of the bore being equal to the smallest inside diameter of the tubular body 12. The valve is opened and closed by pivoting the ball valve element 16 about an axis which is perpendicular both to the axis of the bore formed through the shutter and to the axis of the tubular body 12.

In conventional manner, not shown in FIG. 1 in order to avoid overcrowding, the ball valve element 16 is pivoted by a piston housed in the wall of the tubular body 12. The control chamber of the piston communicates with an annular space 17 formed between the well casing and the tubing. By applying pressure pulses to this space, the piston is actuated, thereby changing the state of the test valve 14.

Figure 2:
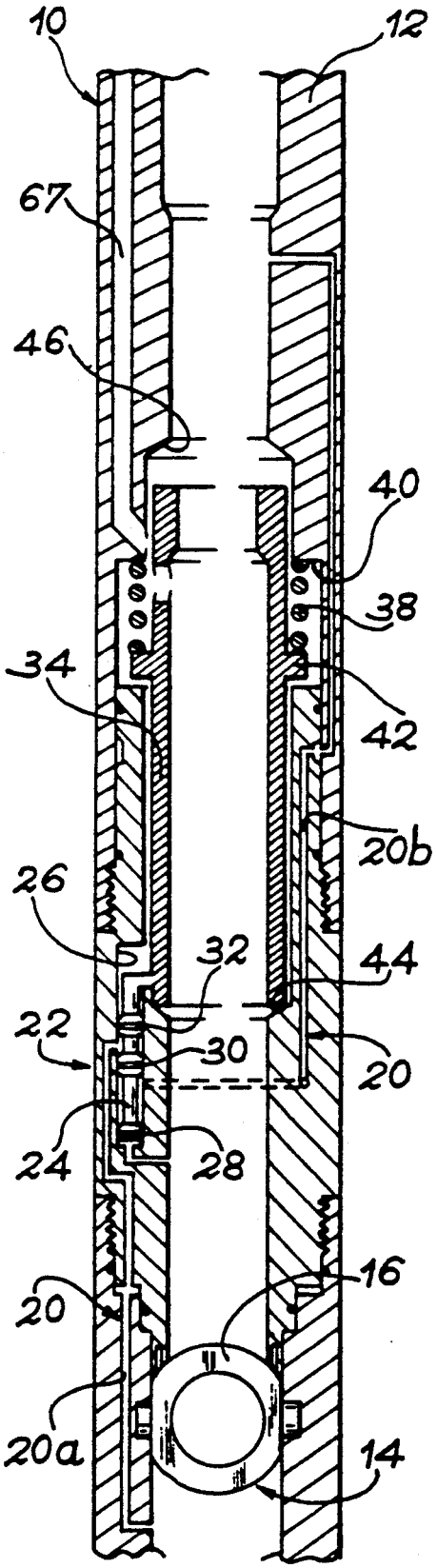
FIG. 2 is a vertical section view on a larger scale showing the tubular test string of the FIG. 1 testing apparatus.

In accordance with the invention, and as shown clearly in FIG. 2, a passage 20 is formed in the wall of the tubular body 12 so as to put the bore of the tubular body situated beneath the valve 14 into communication with the bore of the tubular body situated above said valve. To this end, this passage 20 includes a bottom portion 20*a* which opens out in the bore of the tubular body 12 beneath the valve 14 and a top portion 20*b* which opens out in the bore of the tubular body 12 some distance above the valve 14.

Figure 4:
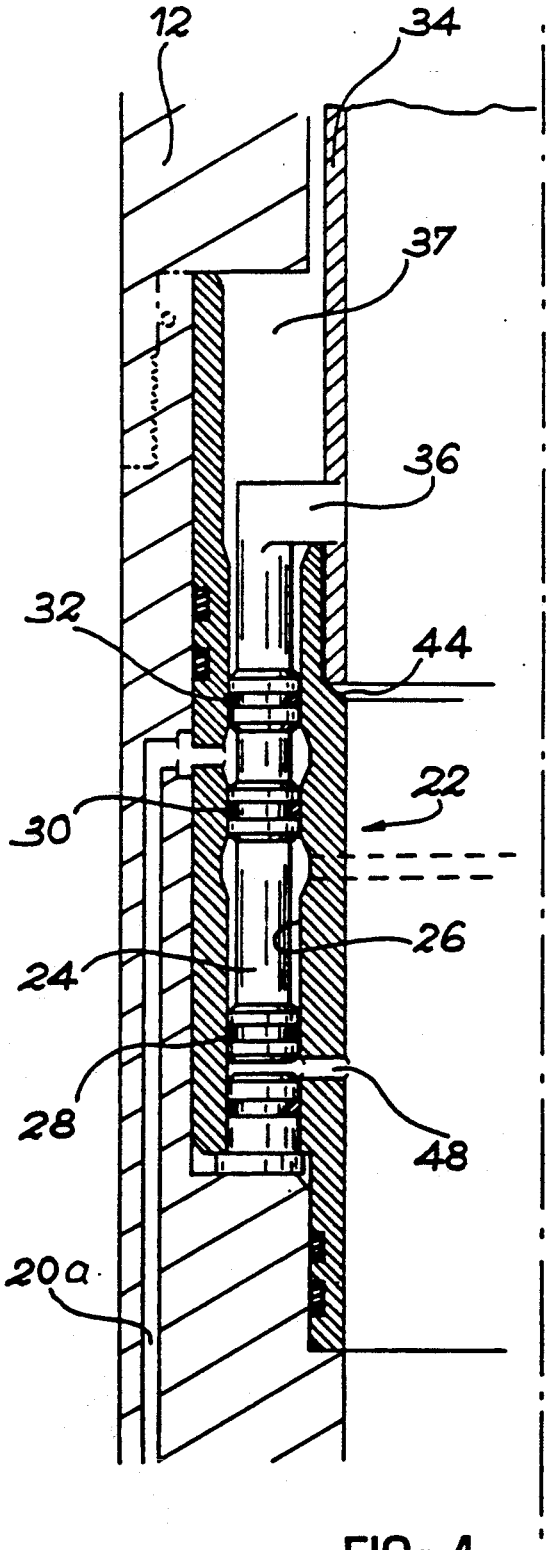
FIG. 4 is a longitudinal section view on a larger scale showing the distributor included in the tubular test string.

According to an essential characteristic of the invention, the portions 20*a* and 20*b* of the passage 20 communicate with each other via a distributor valve 22 which is totally received inside the thickness of the tubular body 12 and which is shown on a larger scale in FIG. 4. This distributor valve 22, which is placed at a level higher than the level of the test valve 14, comprises a cylindrical valve element 24 which is movable in translation inside a chamber 26 of substantially uniform diameter and formed in the thickness of the wall of the tubular body 12. The common axis of the valve element 24 and of the chamber 26 runs parallel to the axis of the tubular body 12 and is offset relative thereto.

As shown in FIGS. 2 and 4, the portions 20*a* and 20*b* of the passage 20 open out into the chamber 26 through orifices which are spaced apart along the axis, with the orifice of the bottom portion 20*a* being at a higher level than the orifice of the top portion 20*b*.

The valve element 24 carries three sealing rings which co-operate in sealing manner with the inside wall of the chamber 26. These sealing rings comprise a bottom sealing ring 28, an intermediate sealing ring 30, and a top sealing ring 32.

Figure 3:
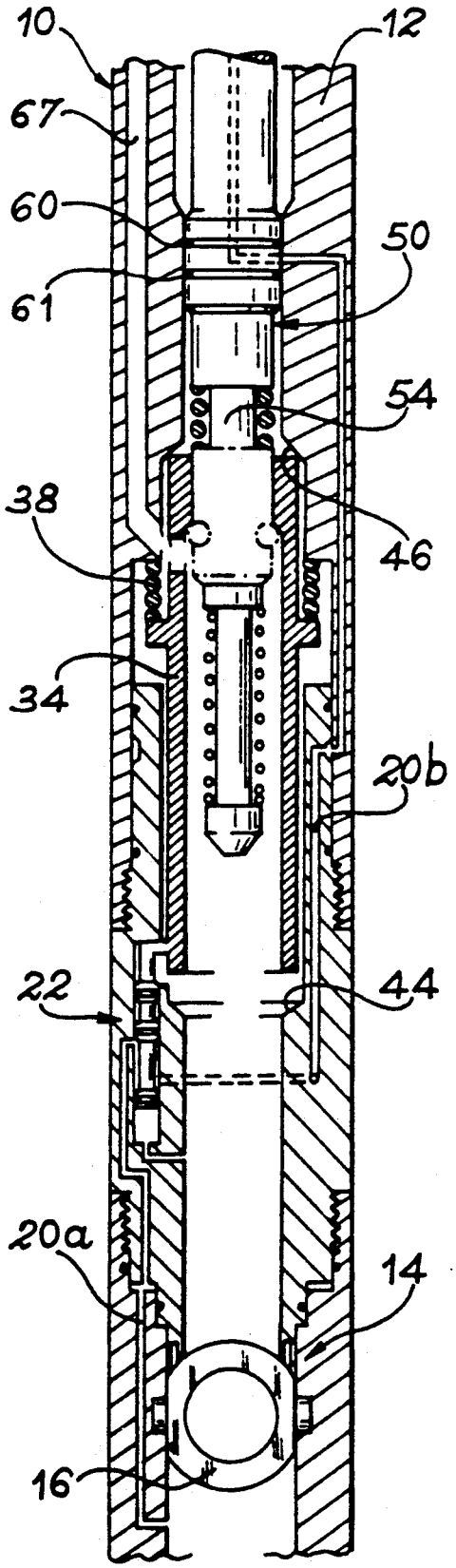
FIG. 3 is a view comparable to FIG. 2 and also showing the bottom end of the wireline assembly of the testing apparatus inserted in the tubular test string when a traction force is exerted on the wireline assembly.

The valve element 24 of the distributor valve 22 is capable of moving inside the chamber 26 between a low position shown in FIGS. 2 and 4 and a higher position shown in FIG. 3.

When the valve element 24 is in its low position, the orifice of the bottom portion 20*a* of the passage 20 is located between the intermediate sealing ring 30 and the top sealing ring 32 carried by the valve element 24. The orifice of the top portion 20*b* of the passage 20 is then located between the bottom sealing ring 28 and the intermediate sealing ring 30 carried by the valve element. Consequently, all communication between the two portions of the passage 20 is then prevented by the intermediate sealing ring 30. This low position of the valve element 24 therefore corresponds to a state in which communication between the two portions of the passage 20 is closed.

In contrast, when the valve element 24 is in its high position as shown in FIG. 3, the orifices of the bottom portion 20*a* and of the top portion 20*b* of the passage 20 are both located between the bottom sealing ring 28 and the intermediate sealing ring 30 carried by the valve element 24. Under these conditions, the two portions of the passage 20 are in communication with each other and the distributor valve 22 is in a position in which communication between these two portions is open.

Given that the distributor valve 22 is received in the thickness of the wall of the tubular body 12, it is very small in diameter as are the sealing rings carried by the valve element 24 of the distributor valve. For example, the outside diameter of these rings may be about 10 mm. Because of this small diameter, the force that needs to be exerted on the valve element 24 in order to displace it is relatively moderate, even when the difference between the pressures existing above and below the valve 14 is large, e.g. as much as 500 bars.

In the embodiment shown in the figures, the valve element 24 of the distributor valve is displaced in its chamber 26 under the control of a sleeve 34 slidably mounted coaxially in the bore of the tubular body 12 of the test string 10. The bottom end of the sleeve 34 has a radially directed hole which receives a radially extending finger 36 (see FIG. 4) fixed to the valve element 24 of the distributor valve. The finger 36 passes through an oblong slot 37 through which the top portion of the chamber 26 communicates with the bore of the tubular body 12. The valve element 24 is thus constrained to move in unison with the sleeve 34.

A helical compression spring (see FIG. 2) is mounted around the sleeve 34 between a shoulder 40 facing downwards in the bore of the tubular body 12 and a collar 42 formed on the sleeve 34. This spring 38 urges the sleeve 34 to a low position as shown in FIGS. 2 and 4, in which the bottom end of the sleeve bears against an upwardly directed shoulder 44 formed in the bore of the tubular body 12. This position corresponds to the closed state of the distributor valve 22.

When a traction force is exerted upwards on the sleeve 34 against the spring 38 in a manner described below, the sleeve 34 is displaced towards a high position shown in FIG. 3 in which the top end of the sleeve 34 bears against a downwards facing shoulder 46 formed inside the tubular body 12. This position corresponds to the open state of the distributor valve 22.

The presence of the compression spring 38 therefore has the effect of normally maintaining the distributor valve 22 in the closed position. Consequently, when no external action is exerted on the sleeve 34, all communication between the two portions 20*a* and 20*b* of the passage 20 is interrupted. When the test valve 14 is closed, the fluid situated beneath this valve is thus totally isolated from the fluid located inside the tubular body, above the test valve 14.

In order to prevent large pressure differences or variations between the fluids situated above and below the test valve 14 having the effect of untimely actuation of the distributor valve 22, the distributor valve is permanently subjected to equal pressures regardless of its state. To this end, and as shown in particular in FIG. 4, the bottom end of the chamber 26 communicates with the bore of the tubular body 12 above the test valve 14 via a duct 48, and the top end of the chamber also communicates with the bore of the tubular body 12 above the test valve 14 via the oblong slot 37 through which the finger 36 passes. The two opposite and same-diameter ends of the valve element 24 are thus permanently subjected to the same pressure. In addition, the pressure existing beneath the test valve 14 and conveyed to the distributor valve by the bottom portion 20*a* of the passage 20 is applied simultaneously and in opposite directions either to sealing rings 30 and 32 when the distributor valve is in its closed position, or else against the sealing rings 28 and 30 when the distributor valve is in its open position. Finally, the pressure existing above the valve 14 and conveyed to the distributor valve by the top portion 20*b* of the passage 20 is always applied simultaneously and in opposite directions to both sealing rings 28 and 30 simultaneously.

The well testing apparatus of the invention also includes a wireline assembly 50. The bottom portion of this assembly is shown very diagrammatically in FIG. 3, and in greater detail in FIG. 5. This wireline assembly is designed to be suspended from an electrically conductive cable 51 (FIG. 1) so as to enable it to be lowered down the tubing 11 and coupled to the tubular body 12 and to the sleeve 34 of the tubular test string 10 when tests are to be performed. After testing has been completed, this wireline assembly 50 can then be raised back to the surface and removed from the well by means of a winch provided for this purpose.

As shown in particular in FIG. 1, the wireline assembly 50 has a measurement device 53 at the top thereof including a pressure sensor and generally associated with a temperature sensor and a flow meter. The values of the measurements performed by these various sensors are immediately transmitted to the surface by an electrically conductive cable 51 so as to enable them to be exploited in real time by an operator.

In its portion situated beneath the measurement device 53, the wireline assembly 50 includes a generally tubular housing 52 (FIG. 5) slidably supported by a central actuator rod 54. The housing 52 includes retractable latch fingers 56 resiliently urged outwards by springs 57 so as to enable them to be received in a complementary portion provided for this purpose in the top portion of the tubular body 12 of the tubular test string 10, as shown diagrammatically in FIG. 1. When the wireline assembly 50 is inserted in the tubular test string 10, the latch fingers 56 automatically lock the housing 52 inside the tubular housing 12 in a given relative position for which the testing apparatus is in an operating state.

The bottom end of the housing 52 has a radial hole 58 which, when the housing 52 is coupled in the tubular body 12 by its latch fingers 56, is at the same level as the opening of the portion **20*b* of the passage 20 into the bore of the tubular body 12. Sealing rings 60 and 61 are disposed around the housing 52 respectively above and below the hole 58 and they co-operate with the inside surface of the tubular body 12 in such a manner that communication between the hole 58 and the passage 20 takes place in sealed manner (see FIG. 3**).

The actuator rod 54 has a central passage 62 running along its axis with the bottom end thereof opening out radially into an annular space 64 formed between the housing 52 and the rod 54, said space being delimited by two sealing rings 66 carried by the rod 54 and having the hole 58 opening out therein. The spacing between the sealing rings 66 is such that the hole 58 is permanently in communication with the bottom end of the central passage 62 regardless of the relative axial position between the rod 54 and the tubular housing 52. The top end of the passage 62 serves to direct the fluid conveyed by the passage 20 and the hole 58 to the measurement device 53 situated at the top end of the wireline assembly 50.

A bypass duct 67 formed in the tubular body 12 serves to put the portion of bore of the tubular body situated beneath the space 64 as delimited by the sealing rings 66 into communication with the portion situated thereabove, in order to equalize pressures.

The actuator rod 54 extends downwards beyond the bottom end of the housing 52 and supports a coupling ring 68 for coupling said rod to the sleeve 34 in order to control displacement of the sleeve. This ring 68 includes radial holes receiving latch balls 70 whose diameters are slightly greater than the thickness of the ring. The ring 68 is mounted on a larger diameter portion 72 of the rod 54 delimited between a top shoulder 71 facing upwards and a bottom shoulder 73 facing downwards. The length of the ring 68 is approximately equal to the length of said portion 72.

A first helical compression spring 74 is mounted around the rod 54 between the bottom end of the housing 52 and a collar formed on a thrust piece 76 which normally bears against the top shoulder 71.

Another helical compression spring 78 is placed around the bottom portion of the rod 54 between a shoulder 80 facing upwards and formed on the bottom portion of the rod, and a washer 82 which normally bears against the bottom shoulder 73.

Figure 5:
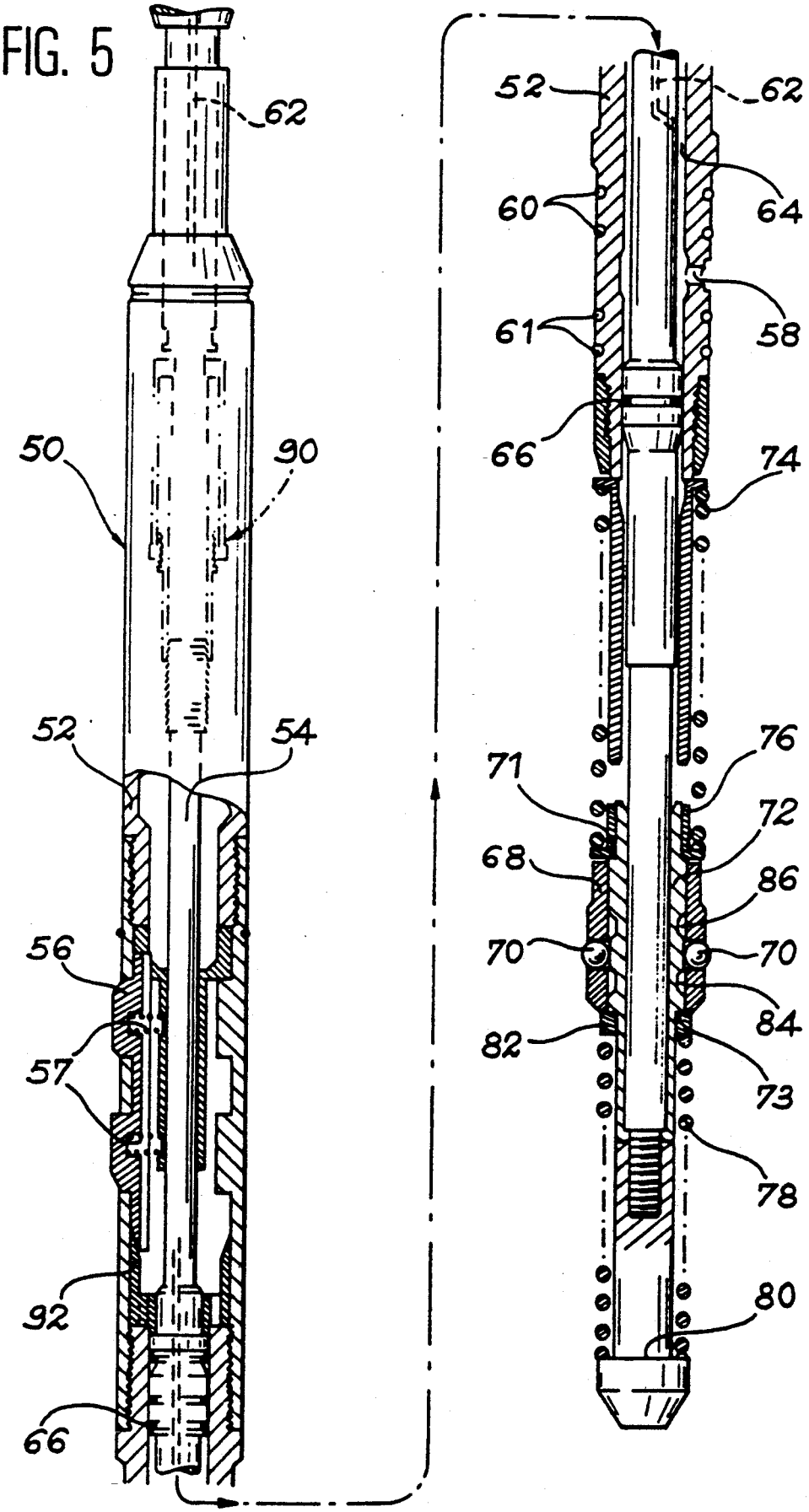
FIG. 5 is a longitudinal section view of the wireline assembly of the testing apparatus of the invention with the top and bottom portions thereof being shown respectively to the left and the right of the figure.

Under the combined effect of the springs 74 and 78, the ring 68 is normally maintained in an intermediate position shown in FIG. 5 in which the latch balls 70 are maintained in extended positions projecting out from the ring, by the outside surface of the larger diameter portion 72 of the rod 54. Two annular grooves 84 and 86 are formed in the outside surface of the portion 72 of the rod 54 respectively slightly above and slightly below the level occupied by the latch balls 70 when the ring 68 is in this intermediate position.

The operation of this mechanism for coupling the actuator rod 54 to the sleeve 34 is described below with reference to FIGS. 6 to 9.

When the wireline assembly 50 is lowered down the well at the end of the cable supporting it, the ring 68 initially occupies the intermediate position shown in FIG. 5 due to the combined action of the springs 74 and 78. Towards the end of the descent, the ring 68 begins to penetrate in a portion **34*a* of smaller inside diameter formed at the top end of the sleeve 34. Since the inside diameter of this portion 34*a* is approximately equal to the outside diameter of the ring 68, the balls 70 come into abutment against the top end of the sleeve 34. The ring 78 is then held stationary by the sleeve 34. As the actuator rod 54 continues to move downwards, the spring 74 is compressed until the balls 70 come level with the top groove 86, the ring 68 then occupies a high position on the rod 54**.

Figure 6:
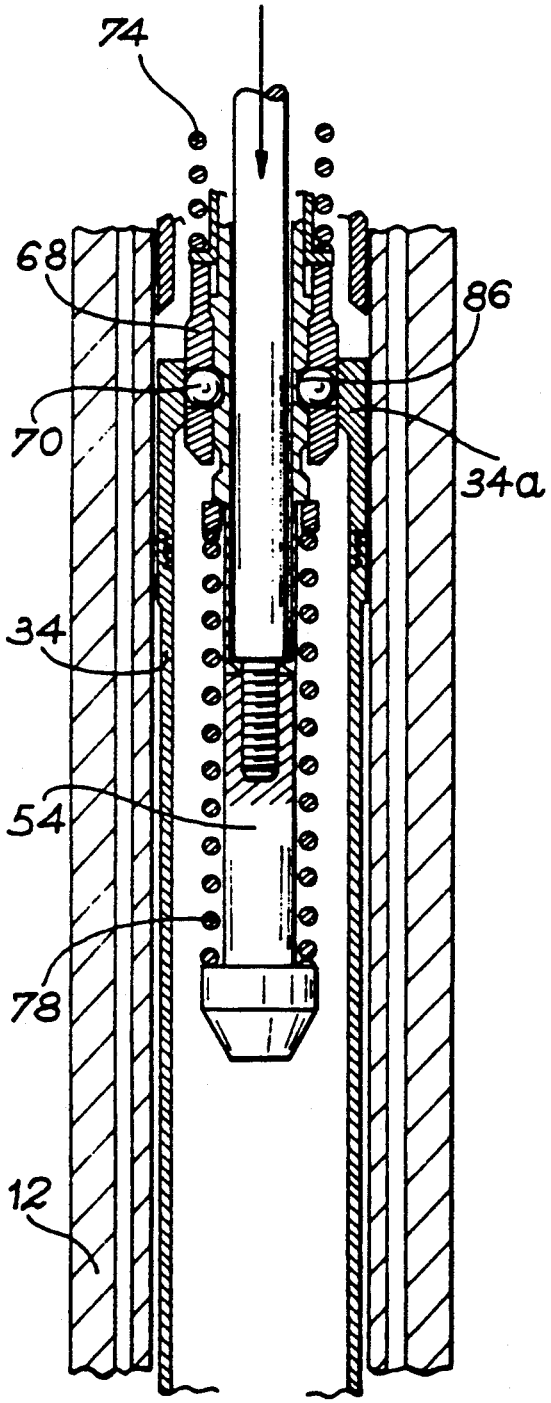
FIG. 6 is a longitudinal section view on a larger scale showing the insertion of the end of the wireline assembly into the tubular test string.

When the balls 70 come level with the top groove 86 they retract into the groove such that the rod 54 causes the ring 68 to start moving down again through the smaller diameter portion **34*a* of the sleeve 34 as illustrated in FIG. 6**.

As soon as the balls 70 come below the portion **34*a* of the sleeve 34, they are displaced radially outwards and leave the groove 86 such that the ring 68 moves down along the rod 54 and returns to its intermediate position under the action of the spring 74. When the latch fingers 56 mounted in the tubular housing 52 of the wireline assembly 50 engage in the corresponding recesses formed in the tubular body 12 of the test string 10, the balls 70 are thus at a given distance beneath the downwards facing shoulder 75 delimiting the bottom of the smaller diameter portion 34*a* of the sleeve 34, in the position shown in FIG. 5**. The testing apparatus is then ready for use.

Figure 8:
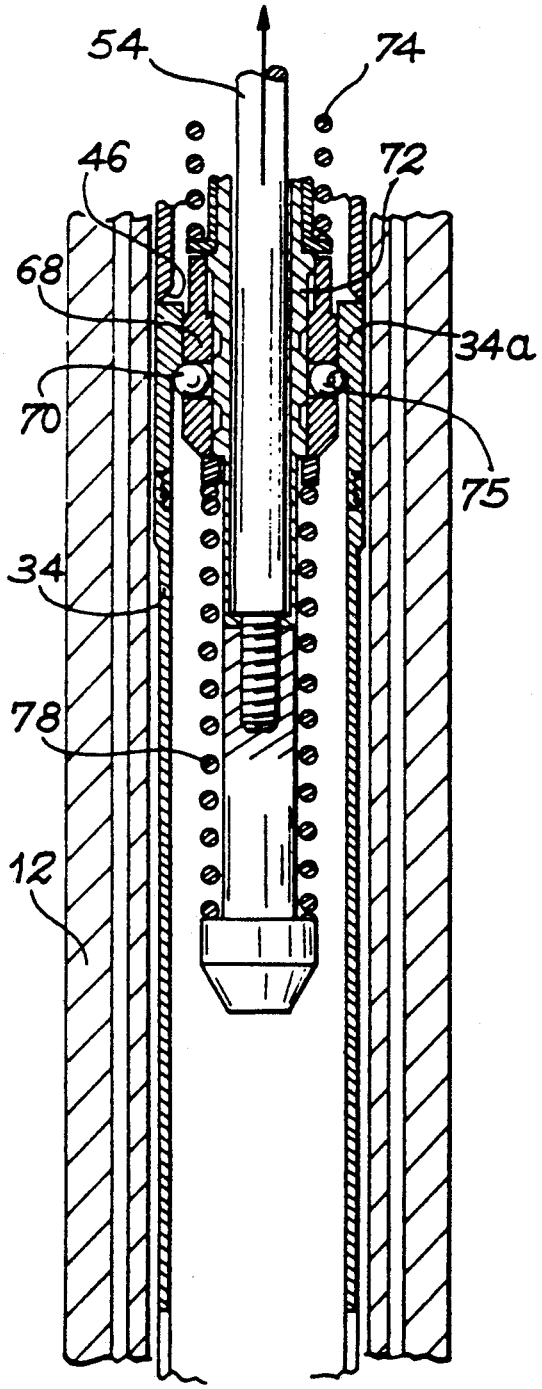
FIG. 8 is a view comparable to FIGS. 6 and 7 showing the positions occupied by the various components when a traction force is subsequently exerted on the cable.

Under these conditions, if the operator desires to perform a measurement, a traction force is applied to the cable 51 supporting the wireline assembly 50 by means of a winch provided for this purpose. Initially, this traction force has the effect of taking up the slack existing between the balls 70 and the shoulder 75. Thereafter, the effect of the traction force is to raise the sleeve 34 without the ring 68 moving over the larger diameter portion 72 of the rod 54. The force exerted by the spring 78 to oppose downwards displacement of the spring 68 is greater than the force exerted by the spring 38 opposing upwards displacement of the sleeve 34. The sleeve 34 continues to move until it comes into abutment against the top shoulder 46, as shown in FIG. 8. Under these conditions, as described above with reference to FIG. 3, the distributor valve 22 is open. The measurement device 53 mounted in the top portion of the wireline assembly 50 is then in communication with the space situated beneath the valve 14 regardless of whether the valve 14 is opened or closed.

Figure 7:
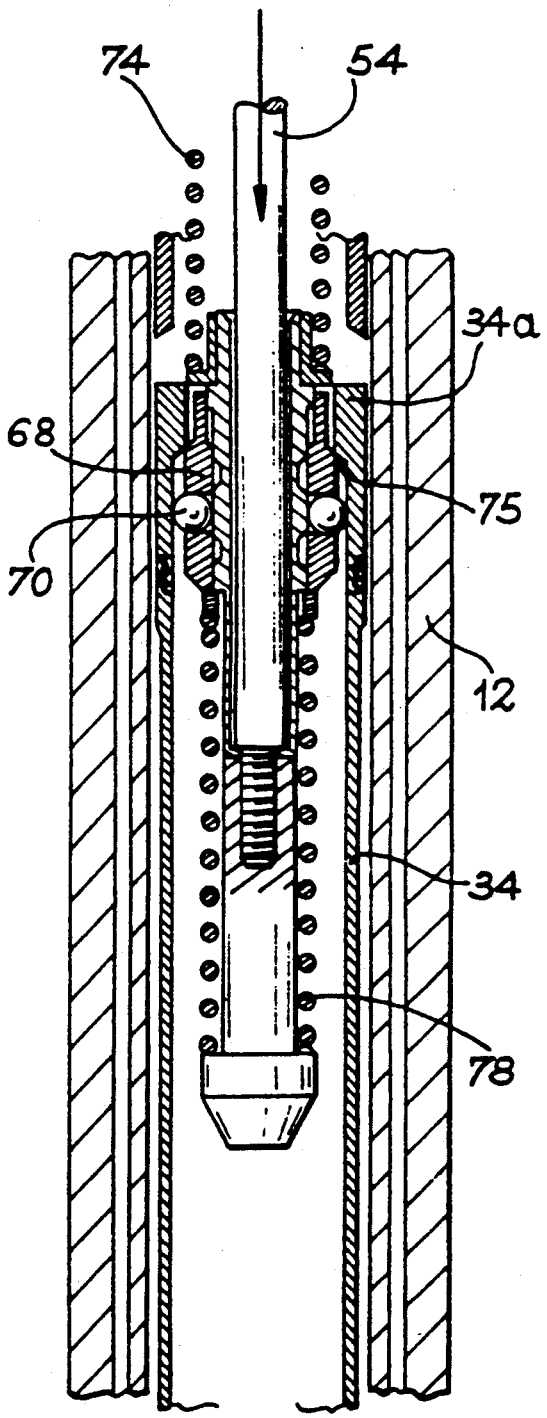
FIG. 7 is a view comparable to FIG. 6 showing the same components after insertion has been terminated.

As soon as the traction force exerted on the cable is released, the rod 54 moves back downwards together with the sleeve 34, and these two parts return to their positions as illustrated in FIG. 7.

A certain number of measurements can be performed in this way by exerting a traction force on the cable supporting the wireline assembly 50 each time a measurement is to be performed. By virtue of the small diameter of the distributor valve 22, this traction force is sufficiently small to avoid any risk of the cable breaking, regardless of the pressure difference that may exist across the test valve 14 when said valve is closed.

In conventional manner, the wireline assembly normally includes a pawl or cam mechanism above the latch fingers 56 and generally designated by reference 90 in FIG. 5 having the effect, once a predetermined number of measurements have been performed, of enabling the latch fingers 56 to be automatically retracted when a further traction force is exerted on the rod 54 by virtue of the rod 54 actuating by a wedge-shaped piece 92. The mechanism 90 does not form part of the present invention and may be embodied in any appropriate manner.

Figure 9:
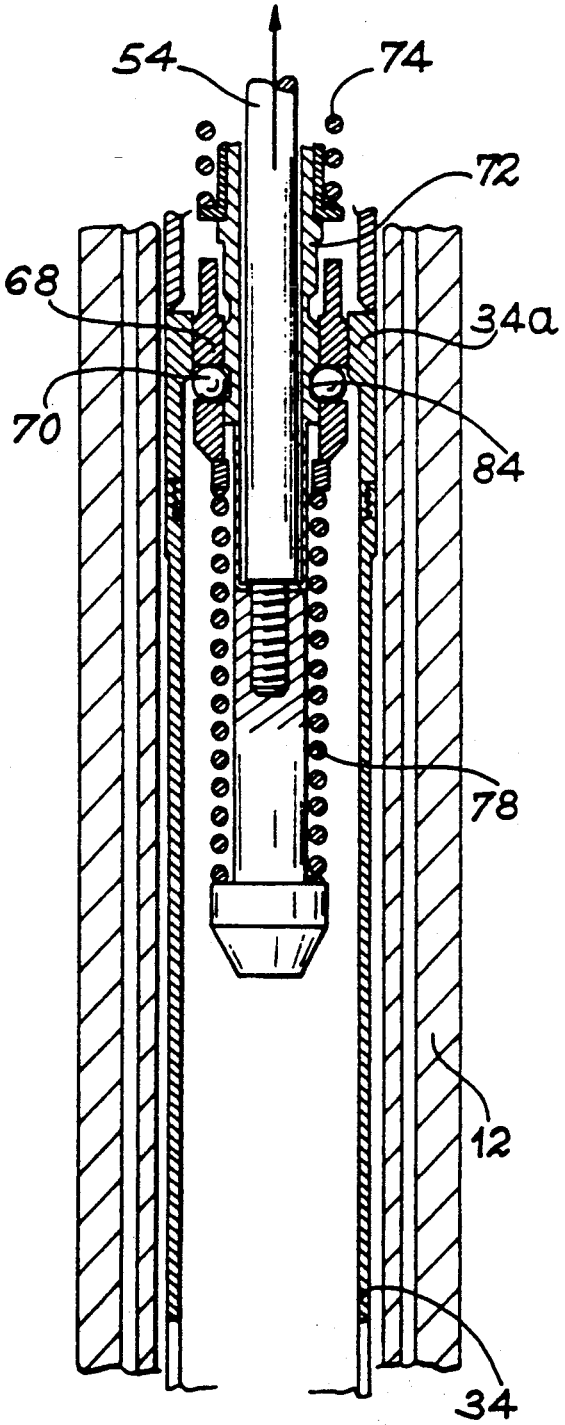
FIG. 9 is a view comparable to FIGS. 6 to 8 showing how the wireline assembly is disconnected from the tubular test string once measurements have been terminated.

Also, as shown in FIG. 9, the ring 68 is simultaneously decoupled from the sleeve 34 by exerting a traction force on the cable 51 which is greater than the traction force exerted during measurement for controlling displacement of the sleeve. The effect of this greater traction force is to displace the actuator rod 54 upwards inside the ring 68 until the balls 70 come level with the bottom groove 84 by compressing the spring 78. When the balls come level with the bottom groove 84, they retract into the groove under the action of the spring 78 and the ring 68 moves up together with the rod 54 through the smaller inside diameter top portion 34*a* of the sleeve 34. The wireline assembly is thus completely released from the tubular test string and may be raised to the surface.

In accordance with the invention, the testing apparatus described above can be used for performing measurements in real time while using a test valve having a ball valve element under separate control, without actuation of the distributor valve for conveying information concerning the fluid to the measurement device requiring the application of too high a traction force that could lead to untimely breaking of the cable. In addition, the principle used makes it possible to ensure that all of the measurements are performed while the cable is under tension. Further, since the opening and closing of the well is under the control of a ball valve, the well is opened almost instantaneously. Naturally, omitting the flapper valve used in the prior art also makes it possible to avoid any danger of such flapper valve latching onto a tool passing through the testing apparatus, with the ball valve always leaving an unencumbered passage for such a tool whenever it is open.

Naturally, the invention is not limited to the embodiment described above by way of example, but extends to any variant thereof. In particular, it will readily be understood that the various coupling means used between the housing of the wireline assembly and the tubular body of the test string, and between the actuator rod of the wireline assembly and the sleeve of the tubular test string may be modified without thereby going beyond the scope of the invention. The invention also covers a case where the actuator member of the wireline assembly couples directly on the valve element of the distributor valve. Finally, the invention is independent of the actuator means used for actuating the test valve such that these means may be different from those described above.

I claim:

1. Apparatus for testing a well, comprising:

a tubular body adapted to be connected to a production tubing; a test valve mounted in said body and controlled from the surface for closing the well; passage means within said body communicating with the bore of said tubular body via first and second openings disposed above and below said test valve;

a distributor valve movably mounted within the wall of said tubular body between a closed and an open position of said passage means, said distributor valve including coupling means extending into the bore of said tubular body;

a wireline assembly suspended from an electrically conductive cable, said wireline assembly including a measurement device and a housing which is adapted to be releasably attached to said tubular body in a position where said measurement device is in fluid communication with the first opening of said passage means; and an actuator movably mounted in said housing and releasably engageable with said coupling means for actuating said distributor valve between said closed and open positions in response to traction exerted on the cable.

2. Apparatus according to claim 1, further comprising resilient means for normally urging said distributor valve towards said closed position.

3. Apparatus according to claim 1, wherein said distributor valve comprises:

a valve element mounted for translation parallel to the axis of said tubular body in a chamber of said tubular body; and upper, lower and intermediate sealing means disposed on said valve element and slidably engaging said chamber wall, said passage means opening out in said chamber at first and second orifices disposed between said upper and lower sealing means and longitudinally spaced apart such that said intermediate sealing means is located (i) between said orifices when said distributor valve is in the closed position and (ii) outside the interval between said orifices when said distributor valve is in said open position.

4. Apparatus according to claim 3, wherein said distributor valve further comprises first and second ducts in said tubular body for communicating the bore of the tubular body to the opposite ends of said chamber respectively to balance the pressures above and below said valve element.

5. Apparatus according to claim 3, wherein said coupling means comprises a sleeve member movably mounted coaxially inside the tubular body and attached to said valve element, said actuator being releasably engageable with said sleeve member.

6. Apparatus according to claim 4, wherein said coupling means comprises a sleeve member movably mounted coaxially inside the tubular body and attached to said valve element, said actuator being releasably engageable with said sleeve member.

7. Apparatus according to claim 1, wherein said actuator comprises a rod movable in translation in said housing and latching means on said rod for releasably coupling said rod to said coupling means of said actuator valve.

8. Apparatus according to claim 7, wherein said latching means comprises:

a ring member slidably mounted on the rod between a high position and a low position; spring means for normally maintaining the ring member in an intermediate position between said high and low positions; and latch members carried by the ring member and movable between (i) extended positions where said ring member is locked with said sleeve member when said ring member is in said intermediate position and (ii) retracted positions where said ring member is released from said sleeve member when the ring member is in one of said high and low positions.

9. Apparatus according to claim 8, wherein said spring means are designed to exert a first predetermined force for normally maintaining the ring member in said intermediate position, further comprising resilient means for exerting a second predetermined force to urge said distributor valve towards said closed position, said first predetermined force being greater than said second predetermined force.

10. Test string apparatus for testing a well comprising:

a tubular body adapted to be connected to a production tubing;

a test valve mounted in said body and controlled from the surface for closing the well;

passage means in said body communicating with the bore of said tubular body via first and second openings respectively disposed above and below said test valve;

a distributor valve movably mounted within said tubular body between a closed and an open position of said passage means wherein said distributor valve comprises;

a valve element mounted for translation parallel to the axis of said tubular body in a chamber of said tubular body; and upper, lower and intermediate sealing means disposed on said valve element and slidably engaging said chamber wall, said passage means opening out in said chamber at first and second orifices disposed between said upper and lower sealing means and longitudinally spaced apart such that said intermediate sealing means is located (i) between said orifices when said distributor valve is in the closed position and (ii) outside the interval between said orifices when said distributor valve is in said open position;

first coupling means on said body for releasably attaching a wireline assembly lowered in the tubing by a cable and communicating the first opening of said passage means with a measurement device located in said wireline assembly; and second coupling means on said distributor valve, said second coupling means extending into the bore of said tubular body to be engageable by the wireline assembly so that said distributor valve can be operated by the wireline assembly in response to traction exerted on the cable.

11. Apparatus according to claim 10, further comprising resilient means for normally urging said distributor valve towards said closed position.

12. Apparatus according to claim 10, wherein said distributor valve further comprises first and second ducts in said tubular body for communicating the bore of the tubular body to the opposite ends of said chamber respectively, to balance the pressures above and below said valve element.

13. Apparatus according to claim 10, wherein said second coupling means comprises a sleeve member movably mounted coaxially inside the tubular body and attached to said valve element, the wireline assembly being releasably engageable with said sleeve member.

14. Apparatus according to claim 12, wherein said second coupling means comprises a sleeve member movably mounted coaxially inside the tubular body and attached to said valve element, the wireline assembly being releasably engageable with said sleeve member.

* * * * *